United States Patent [19]

Guy

[11] 4,096,894

[45] Jun. 27, 1978

[54] DUST COLLECTION DEVICE

[75] Inventor: Richard Ernest Guy, Baytown, Tex.

[73] Assignee: E. I. Du Pont de Nemours and Company, Wilmington, Del.

[21] Appl. No.: 823,325

[22] Filed: Aug. 10, 1977

[51] Int. Cl.[2] ..... B65B 1/28

[52] U.S. Cl. ..... 141/93

[58] Field of Search ..... 141/93, 59, 285

[56] References Cited

U.S. PATENT DOCUMENTS

| | | | |
|---|---|---|---|
| 1,981,485 | 11/1934 | Westin | 141/93 X |
| 2,105,589 | 1/1938 | Eades | 141/93 |
| 2,524,560 | 10/1950 | Cote | 141/93 |

*Primary Examiner*—Harry N. Haroian

[57] ABSTRACT

This invention relates to dust collection and, more particularly, to the collection of dust and the reduction of product giveaway when packaging flowable powders.

4 Claims, 4 Drawing Figures

DUST COLLECTION DEVICE

BACKGROUND OF THE INVENTION

In many packaging operations, e.g., packaging finely ground formulations of herbicides, fungicides and insecticides into cans, jars or bags, there is a need for improved filling efficiency and uniformity with reduced dusting and product giveaway. Reducing giveaway and airborne dust is most difficult when filling containers with flowable powders and the like where the average particle size of the material is generally smaller than about 150 microns by weight. Powders, in particular, can exhibit flowability characteristics similar to liquids.

A typical filling machine for dispensing flowable granules and powders into containers is a multi-head automatic filler (Model 43-A Bulk and Dribble Filler, Mateer-Burt Co., Wayne, Pa., for example) having a first station for bulk filling, i.e., where about 90 to 95% of and fill quantity is dispensed into the containers, and a second station for trim or dribble filling and weight control. Containers to be filled typically are transported during the filling process by suitable conveying means. Powders are normally dispensed into the containers at both stations by an auger through a generally vertical elongated filler tube. However, such materials do not readily bridge, and they may continue to flow slowly or dribble, or become dislodged by vibration, from the end of the filler tube even though the filling cycle has stopped and the auger is stationary. Product dripping from the filler tube can fall to the conveyor or floor and produce high levels of airborne dust. If the dribble occurs while a properly filled container is still at the trim filling station, containers can be overfilled resulting in significant product giveaway.

It has been found that product giveaway and dusting in close proximity to a filling station can be reduced with this invention which is particularly pointed out in the appended claims and is illustrated in a preferred embodiment in the accompanying drawings wherein:

Figure 1:
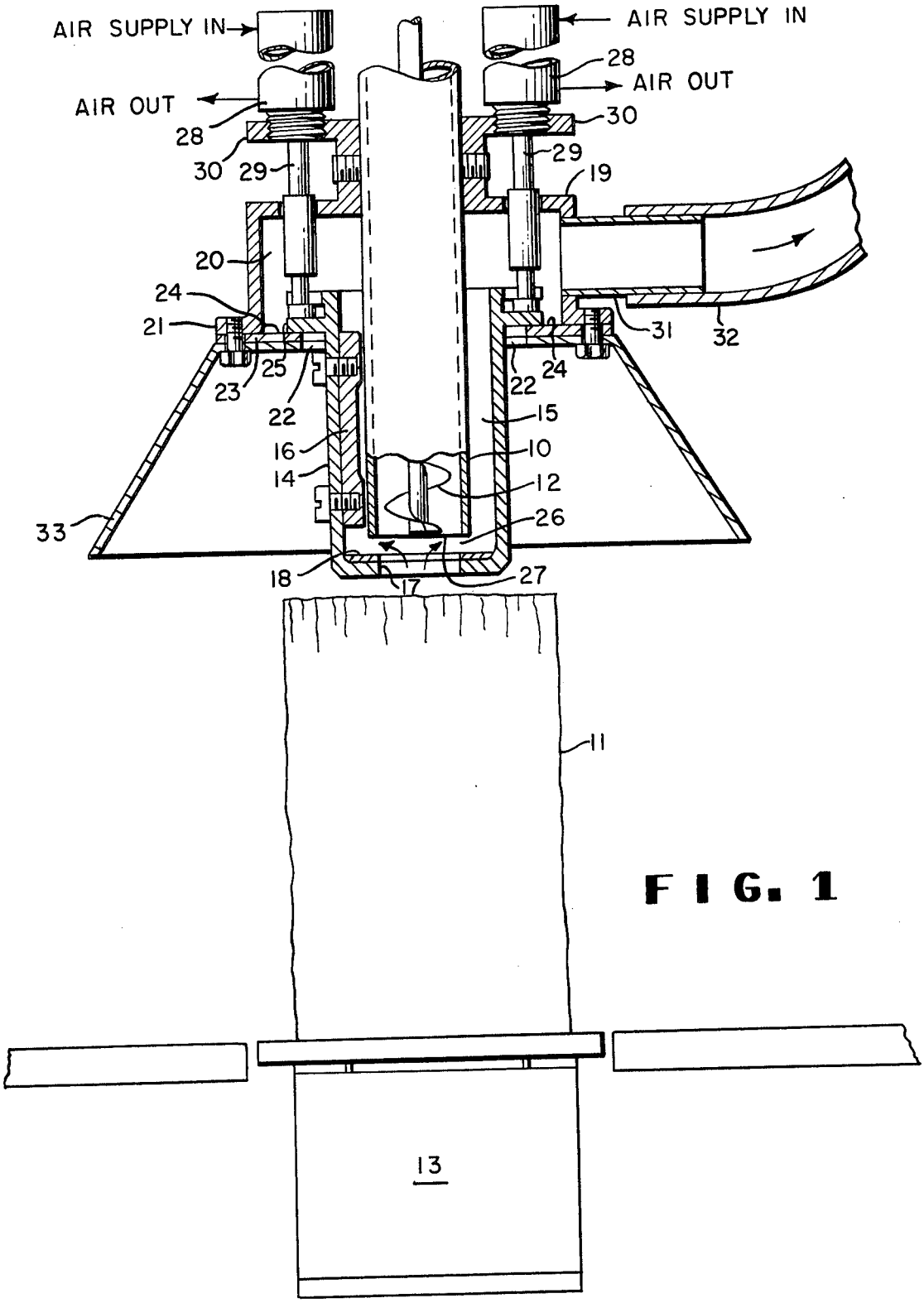
FIG. 1 is a sectional view taken along the verticle axis of a typical trim filler tube which shows this invention in relation to the filler tube immediately after a trim filling cycle.

Referring now to FIG. 1, at a typical filling station powders and granules are metered or dispensed through a generally vertical elongated filler tube 10 into an appropriate container 11 by a rotating auger 12. In a multi-head filling machine having a first station for a bulk fill and second station for trim fill, container 11 receives about 90 to 95% of the fill quantity at the bulk station and is automatically delivered by conveyor to the trim fill station and positioned below filler tube 10 on weigh cell 13. A photoelectric cell or other sensing device senses the presence of an underweight container 11 and engages an electronic weighing circuit which initiates the trim fill cycle. When a predetermined gross weight is achieved, the sensing device commands auger 12 to stop dispensing the product, and container 11 is discharged from the trim fill station onto the conveyor for the next step in the filling process. Product may inadvertently discharge from the filler tube 10 between filling cycles, however, and produce airborne dust, housekeeping problems or result as giveaway.

In a preferred embodiment of the present invention, a sleeve 14 is arranged about the lower portion of filler tube 10 to form a coaxial annular cavity 15 between the outer surface of filler tube 10 and the inner surface of sleeve 14. Spacers 16 are arranged to extend radially from the inner surface of sleeve 14 to maintain a coaxial alignment between filler tube 10 and sleeve 14.

The lower end of sleeve 14 is arranged to form an inwardly facing peripheral edge 17 having an inside diameter generally equal to the inside diameter of filler tube 10. Gasket 18 is attached to edge 17 to form an annular sealing surface below the end of filler tube 10.

A dust collecting chamber 19 is mounted on the upper portion of filler tube 10 coaxial therewith. Chamber 19 extends outwardly to form an annular cavity 20 about the upper portion of filler tube 10 and terminates in a peripheral edge 21 which forms an opening 22 surrounding sleeve 14. A suitable gasket 23 is applied to peripheral edge 21 to form sealing surface 24. Gasket 18 and 23 may be selected from any natural or synthetic generally soft sealing material such as rubber, polyethylene or tetrafluoroethylene (hereinafter Teflon ®).

The upper end of sleeve 14 forms an outwardly extending peripheral edge 25 which is arranged to mate with sealing surface 24. Sleeve 14 is arranged to move reciprocally along the longitudinal axis of filler tube 10 from a first position at which the upper end thereof engages sealing surface 24 while the lower end thereof forms an annular opening 26 around the bottom of filler tube 10 to a second position at which sealing surface 18 engages the bottom end 27 of filler tube 10 while the upper end thereof forms an annular opening 22 between sealing surface 24 and peripheral edge 25.

Movement of sleeve 14 can be accomplished with one or more double acting air cyclinders 28 mounted above the sleeve parallel to the axis along which the sleeve is to move. Cylinders 28 communicate with the upper end of sleeve 14 by means of connecting rods 29 attached thereto by any suitable means. In a preferred embodiment the upper portion of chamber 19 forms an upper mounting flange 30 on which cylinders 28 are mounted. This particular arrangement prevents dust in cavity 20 from affecting the smooth sliding movement of cylinder connecting rod 29.

Dust collecting chamber 19 is equipped with nozzle 31 to which is attached vacuum hose 32. During operation of the filling machine a partial vacuum is continuously pulled on chamber 19. Any type of vacuum pump or suction device of suitable capacity may be used.

At the termination of a filling cycle auger 12 stops rotating while cylinders 28 simultaneously move sleeve 14 from the first position downward to the second position forming annular opening 26.

A volume of air drawn into and across the bottom of filler tube 10 through annular opening 26 by the vacuum system operates to capture any powder which could inadvertently discharge or escape from the end of the filler tube 10.

When a new trim filling cycle is initiated, cylinders 28 simultaneously pull sleeve 14 upward to the first position. The lower end of sleeve 14 thereby engages the bottom end 27 of filler tube 10 while the upper end thereof forms annular opening 22. Airborne dust generated by the filling cycle is then pulled through opening 22 by the vacuum system. Where appropriate, a dust hood 33 can be arranged about the lower portion of sleeve 14 to assist in controlling the dissemination of airborne dust beyond the immediate vicinity of the filling station.

Figure 2:
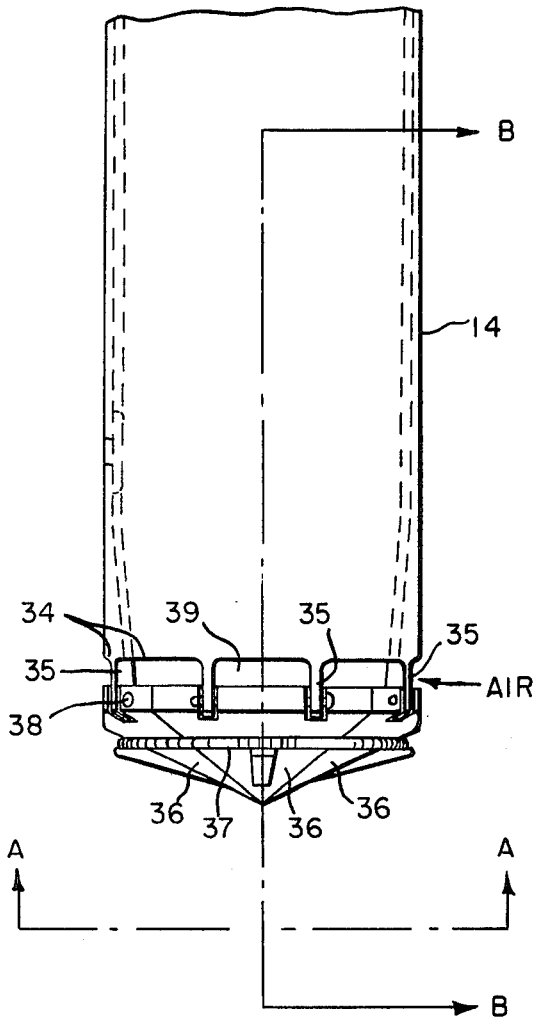
FIG. 2 is an elevational view of an embodiment of the instant invention particularly suited for a bulk filler tube.
Figure 3:
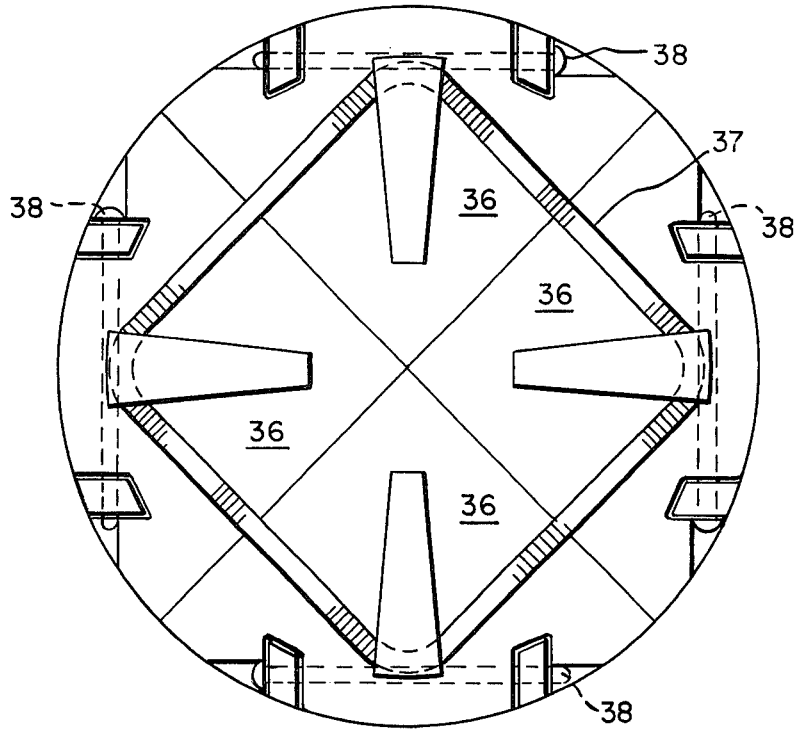
FIG. 3 is a sectional view taken along line A—A of FIG. 2.
Figure 4:
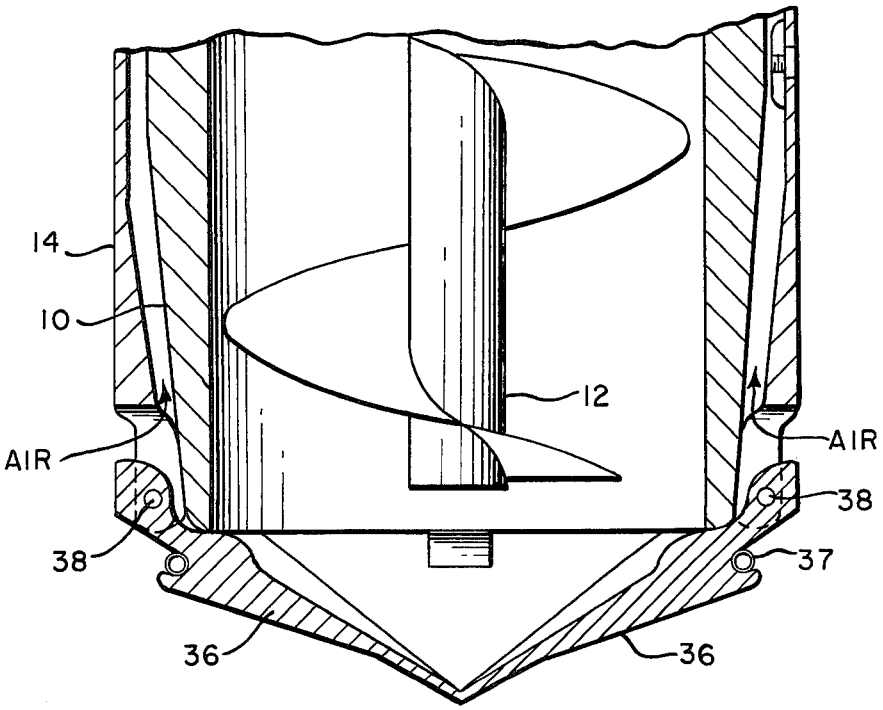
FIG. 4 is a view taken along line B—B of FIG. 2.

Referring now to FIGS. 2, 3, and 4, there is shown another embodiment within the spirit and scope of the present invention and particularly suited for a bulk filling station. The lower end of sleeve 14 terminates in a peripheral edge 34 having a plurality of downwardly extending fingers 35 with a plurality of leaves 36 mounted thereon, each arranged for pivotal movement about a pivot point 38 from a first position at which leaves 36 are sealingly engaged over the end of filler tube 10 to a second position at which leaves 36 are pivoted outwardly in surrounding relation to filler tube 10. The pivotal movement of leaves 36 is accomplished with the simultaneous reciprocal movement of sleeve 14. Continuous spring 37 is attached to the outer surface of each leaf 36 and arranged to pull the leaves into sealing engagement when sleeve 14 is moved downward simultaneously with the termination of a bulk filling cycle. As sleeve 14 is moved upward simultaneously with the initiation of a new filling cycle, leaves 36 are forced outward by the end of the auger tube about pivot point 38 by the relative downward movement of filler tube 10. During a filling cycle, leaves 36 are in surrounding relation to filler tube 10.

Fingers 35 are arranged about peripheral edge 34 to form a plurality of openings 39 through which air is continuously pulled by the vacuum system. Airborne dust generated by the filling cycle is controlled by the continuous volume of air being moved from the immediate vicinity of the filler tube opening. A typical bulk filling station may be equipped with a bottom-up filling feature. When a bulk filling cycle begins, container 11 is moved upward by any suitable means so that the container completely surrounds the lower portion of the filler tube. Airborne dust generated from product discharging into the container may then be captured before it can ever leave the container. Any product which might inadvertently escape or flow from the filler tube between filling cycles when the auger is stationary is contained by leaves 36 which return to their first position with the simultaneous downward movement of sleeve 14.

This invention overcomes housekeeping and quality control problems normally associated with packaging granules and powders into small containers such as cans, jars or bags. Further, this invention can be used with any auger type filling machine having generally vertical filler tubes. Use of the invention is relatively inexpensive and does not require extraordinary equipment or skills.

As many widely different embodiments of this invention may be made without departing from the spirit and scope thereof, it is to be understood that this invention is not limited to the specific embodiments thereof except as defined in the appended claims, and all changes which come within the meaning and range of equivalence are intended to be embraced therein.

What is claimed is:

1. In a container filling machine for powdered materials of the type wherein the material is dispensed into the containers through a generally vertical elongated filler tube, the improvement which comprises, in combination;

a dust collecting chamber mounted on the upper portion of said filler tube coaxial therewith and extending outwardly to form a first annular cavity between said filler tube and the inner surface of said dust collecting chamber, said chamber terminating in a peripheral edge forming an opening surrounding said filler tube, said peripheral edge having a first sealing surface thereon;

a sleeve, coaxial with and moveable along the lower portion of said filler tube, arranged to form a second annular cavity integral with said first annular cavity between the outer surface of said filler tube and the inner surface of said sleeve, the lower end of said sleeve adapted to form a second annular sealing surface with the bottom of said filler tube, the upper end of said sleeve adapted to engage said first sealing surface;

means to move said sleeve reciprocally along the longitudinal axis of said filler tube from a first position at which said upper end of said sleeve engages said first sealing surface while said lower end of said sleeve forms an annular opening around the bottom of said filler tube, to a second position at which said lower end of said sleeve engages said bottom end of said filler tube while said upper end of said sleeve forms an annular opening between said sleeve and said peripheral edge of said chamber; and means for pulling a partial vacuum on said first annular cavity.

2. The improvement as claimed in claim 1 further comprising a dust collecting hood attached to said peripheral edge of said dust collecting chamber and extending outwardly from said peripheral edge to surround said sleeve in spaced relation thereto, said dust collecting hood terminating in a peripheral edge above the lower end of said sleeve.

3. The improvement as claimed in claim 1 wherein said means to move said sleeve reciprocally comprises at least one air cylinder attached to said dust collecting chamber in parallel spaced relation to said filler tube and arranged to engage said upper end of said sleeve.

4. The improvement as claimed in claim 1 wherein the lower end of said sleeve terminates in a peripheral edge having a plurality of downwardly extending fingers with a plurality of leaves mounted thereon and arranged for pivotal movement thereabout from a first position at which said leaves are sealingly engaged over the end of said filler tube to a second position at which said leaves are pivoted outwardly in surrounding relation to said filler tube simultaneously with the reciprocal movement of said sleeve.

* * * * *